United States Patent [19]

Chambers et al.

[11] 4,400,79

[45] Aug. 23, 198

[54] TRANSVERSAL CORRELATOR

[75] Inventors: Ramon P. Chambers, Clearwater; William H. Mosley, Jr., St. Petersburg, both of Fla.

[73] Assignee: E-Systems, Inc., Dallas, Tex.

[21] Appl. No.: 222,992

[22] Filed: Jan. 6, 1981

[51] Int. Cl.[3] ..... G06J 1/00; G06G 7/19

[52] U.S. Cl. ..... 364/604; 364/728; 364/819; 375/1; 375/115

[58] Field of Search ..... 364/819–824, 364/604, 728; 375/1, 96, 115; 371/47, 42, 46

[56] References Cited

U.S. PATENT DOCUMENTS

| | | | |
|---|---|---|---|
| 3,412,334 | 11/1968 | Whitaker | 364/728 |
| 3,432,619 | 3/1969 | Blasbalg | 375/1 X |
| 3,524,169 | 8/1970 | McAuliffe et al. | 364/604 X |
| 3,599,209 | 8/1971 | Goodrich | 364/604 X |
| 3,718,813 | 2/1973 | Williams, Jr. et al. | 364/728 X |
| 4,032,885 | 6/1977 | Roth | 364/728 |
| 4,224,679 | 9/1980 | Nossen et al. | 364/728 |
| 4,346,475 | 8/1982 | Alexis | 364/604 X |

*Primary Examiner*—Joseph F. Ruggiero

*Attorney, Agent, or Firm*—Robert V. Wilder; Albert N Crowder, Jr.

[57] ABSTRACT

A segmented, transversal correlator for use in a sprea spectrum communications system accurately synchr nizes to an incoming spread signal by passively searc ing for a particular section of a known reference P code sequence. To achieve correlator lengths of great than one data bit long, the correlator may comprise plurality of correlation subsections, each including loading register for storing a different section of tl overall reference PN code sequence. A section of tl PN code sequence is transferred into a circulating regi ter in each subsection through a parallel transfer. Tl dynamic, circulating PN code sequence is then corr lated against statically stored analog samples of tl incoming spread signal. When the dynamic PN refe ence code sequence is aligned with the correspondir PN sequence in the analog samples, a correlation sign is produced and magnitude detected to form a sign which is applied to a summation circuit. The summatic circuit receives the outputs of each of the correlat subsections and produces a correlation output signal f the entire correlator.

22 Claims, 7 Drawing Figures

TRANSVERSAL CORRELATOR

TECHNICAL FIELD

The present invention pertains to the decoding of electronic signals and more particularly to the correlation of a received signal with a stored reference signal.

BACKGROUND OF THE INVENTION

In communication systems using spread spectrum techniques, the receiver must be rapidly synchronized to the spread spectrum sequence of the incoming signal. A despreading correlator in the receiver must be activated with sufficiently accurate synchronization to the incoming spread signal such that the timing in the receiver can be set for synchronism with the incoming signal. It has heretofore frequently been the practice to achieve synchronization by comparing the incoming spread spectrum sequence to a corresponding stored reference code. The incoming analog signal is sampled and the resulting samples are shifted through a correlator for comparison with a statically stored reference code. A single serial comparison technique of this type is limited in its effectiveness. When a charge transfer device (CTD) is used as the transversal correlator, the length of the correlator is limited by the cumulative effects of charge transfer inefficiency which limits correlator processing gain. The effectiveness of serial correlation is also limited by data or frequency offsets which effectively limit the useful correlator length.

In view of the limitations in conventional practice for detecting a spread spectrum signal to achieve synchronization, there exists a need for a method and apparatus for correlating an incoming spread spectrum signal with a stored reference code such that substantial correlator lengths can be achieved with such lengths preferably being in excess of one data bit long.

SUMMARY OF THE INVENTION

This specification discloses a method and apparatus for correlating an input signal with a preselected bit sequence, the input signal having spread spectrum modulation corresponding to the preselected bit sequence. Circuitry is provided for periodically sampling the input signal to produce a series of analog samples. A preset number of the analog samples are stored in storage circuits wherein each new sample replaces the oldest stored sample. At least a section of the preselected bit sequence is stored and circulated through a circulating register. Further circuitry is provided for correlating the circulating bit sequence in the circulating register with the analog samples fixed in the storage circuits to produce a correlation signal when the bit sequence in the circulating register is aligned with the corresponding sequence of analog samples in the storage circuits.

In a further embodiment of the present invention a plurality of the subsection correlators, as described above, are connected in series such that there is simultaneous correlation of differing sections of the preselected bit sequence with the incoming analog samples. The correlation signals produced by each of the correlation subsections are summed to produce a correlation output signal.

BRIEF DESCRIPTION OF THE DRAWINGS

For a more complete understanding of the present invention and the advantages thereof, reference is now made to the following description taken in conjuncti with the accompanying drawings in which.

DETAILED DESCRIPTION

Figure 1:
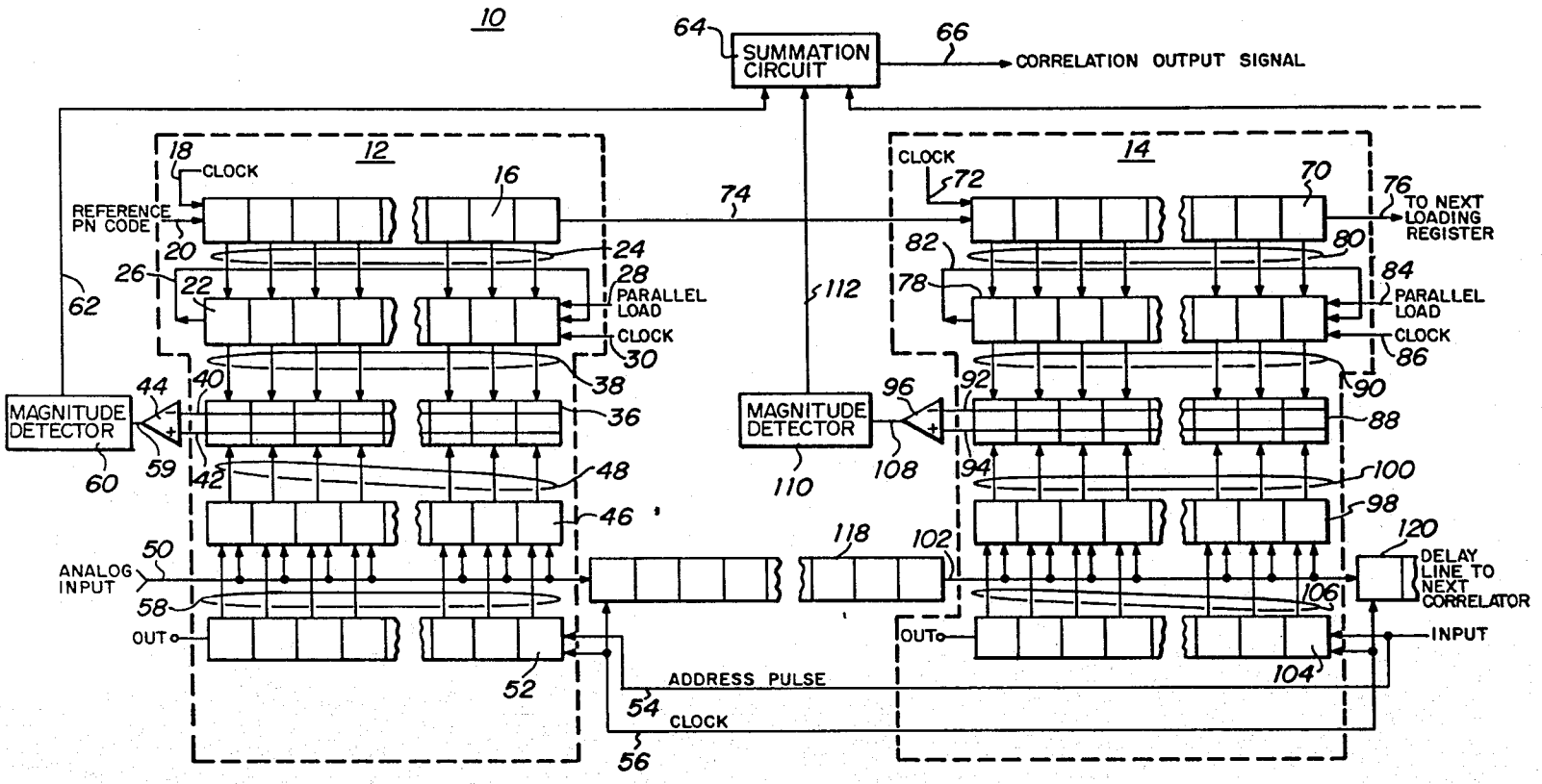
FIG. 1 is a block diagram illustration of a segmente transversal correlator with two correlation subsectic in accordance with the present invention.

A segmented, transversal correlator 10 in accordan with the present invention is illustrated in FIG. 1. Tl correlator 10 comprises a plurality of correlator subse tions as illustrated by subsections 12 and 14. All of tl correlator subsections contain the same physical el ments but each subsection operates independently processing the input signal.

Within the correlator subsection 12 there is includ a reference pseudorandom noise (PN) code register 1 which receives a clock signal through a line 18 to shi the bit sequence stored in register 16. A reference P code is input through a line 20 into the register 16. Tl reference PN code is shifted through the register 16 t the clock signal received through line 18. Convention circuitry, not shown, generates the reference PN coc which comprises a pseudorandom sequence of bits. Tl reference PN code can be changed as desired and als can have differing lengths.

A circulating register 22 has the same number of cel as the reference register 16 within subsection correlat 12. A group of lines 24 connect the corresponding cel in registers 16 and 22 such that the PN code sequenc stored in register 16 can be parallel shifted into regist 22. A line 26 connects the last cell in register 22 with tl first cell of the register such that the PN code stored i the register 16 circulates continuously therein until tl reference code is changed.

The command to parallel load register 22 from regi ter 16 is transmitted through a line 28. The register 2 has the data shifted therein in response to a clock sign received through line 30.

A weighting circuit 36 comprises a plurality of stage Each of the stages in circuit 36 is connected to a corr sponding cell in register 22 through lines 38. Tl weighting circuit 36 includes summation lines 40 and 4 which transfer a summation of signals to a differenti amplifier 44. Summation line 40 is connected to th inverting input of amplifier 44 and summation line 42 connected to the noninverting input of amplifier 44.

A group of sample and hold circuits 46 is provide for storing an analog signal sample in each of the cel thereof. Each of the cells of circuit 46 is connected to corresponding section of the weighting circuit 3 through a group of lines 48. The analog input signal t correlator 10 is supplied through a line 50 which connected to each of the sample and hold cells of circu 46. The cells of circuit 46 are connected to either line 40 or line 42 depending upon the bit state (one or zero) in the corresponding cells of register 22.

Correlator subsection 12 further includes an address shift register 52 which receives a periodic address pulse through a line 54 and receives a clock signal through a line 56 for shifting the address pulse through register 52. As the address pulse is shifted through register 52, it is transferred as a sampling command signal through the lines 58 which are connected respectively between the cells of register 52 and the sample and hold cells of circuit 46. As the address pulse transfers from one cell in register 52 to the next cell it causes the corresponding sample and hold cell in circuit 46 to sample the analog input signal on line 50 and store the analog sample in the cell of circuit 46.

The output of differential amplifier 44 is connected through a line 59 to a magnitude detector 60 which generates an output pulse having a predetermined sense (negative or positive) regardless of the sense of the input signal. The magnitude detector 60 produces an output signal on line 62 for transfer to a summation circuit 64. Circuit 64 sums all the inputs provided thereto to produce a correlation output signal on a line 66.

The correlation subsection 14 is physically identical to the correlation subsection 12. Correlation subsection 14 includes a reference code loading register 70 which receives clock signals through a line 72. The reference PN code signal is transmitted from the loading register 16 through a line 74 to the first cell of register 70. The last cell of register 70 is connected to a line 76 which transfers the reference PN code to the loading register in the next succeeding correlator subsection. Registers 16 and 70 are connected such that the bits of the PN code are included sequentially in registers 16 and 70.

A circulating register 78 receives through a group of lines 80 a parallel transfer of the section of the PN code in register 70. A feedback line 82 connects the last cell of register 78 to the first cell of register 78. A parallel load command is received by register 78 through line 84. The clock signal for causing the PN sequence in register 78 to be circulated is received through a line 86.

A weighting circuit 88 is connected to receive the state of the bits in the PN sequence in the register 78 through a group of lines 90. The weighting circuit 88 includes summation lines 92 and 94 which are connected to the inputs of a differential amplifier 96. Line 92 is connected to the inverting input while line 94 is connected to the noninverting input of differential amplifier 96.

A group of sample and hold circuits 98 are connected through lines 100 to corresponding stages in the weighting circuit 88. The analog input signal is received through a line 102 which is connected to each of the cells of the sample and hold circuits 98. The analog samples in the cells of circuit 98 are summed on lines 92 and 94 depending on the state of the corresponding bits in register 78.

The correlator subsection 14 further includes an address shift register 104 which receives a periodic address pulse through line 54 and a clock signal from line 56. Each of the cells of register 104 is connected to a corresponding circuit in the sample and hold circuits 98 through lines 106.

The output of differential amplifier 96 is transmitted through a line 108 to a magnitude detector 110. Detector 110, like detector 60, serves as a fullwave rectifier which transmits an output signal through a line 112 to the summation circuit 64.

The analog input signal is transmitted serially from correlator subsection 12 to correlator subsection 14 and from there sequentially to the remainder of the correlator subsections within the overall correlator 10. The analog input signal is transmitted from line 50 through an analog delay line 118. The analog delay line 118 has a number of cells such that the time period of the delay through circuit 118 is equal to the time period of the samples stored in the cells of circuit 46. A similar delay circuit 120 is connected to line 102 for supplying the analog input signal to the next sequential correlator subsection downstream from correlator subsection 14. The analog delay line 118 samples the analog input signal at the same rate as the sample and hold circuits 46 and 98.

The signal received at line 50 includes the PN sequence which is synchronized to transmitted data in which the data is transmitted at a sub-multiple of the PN rate.

Figure 2A:
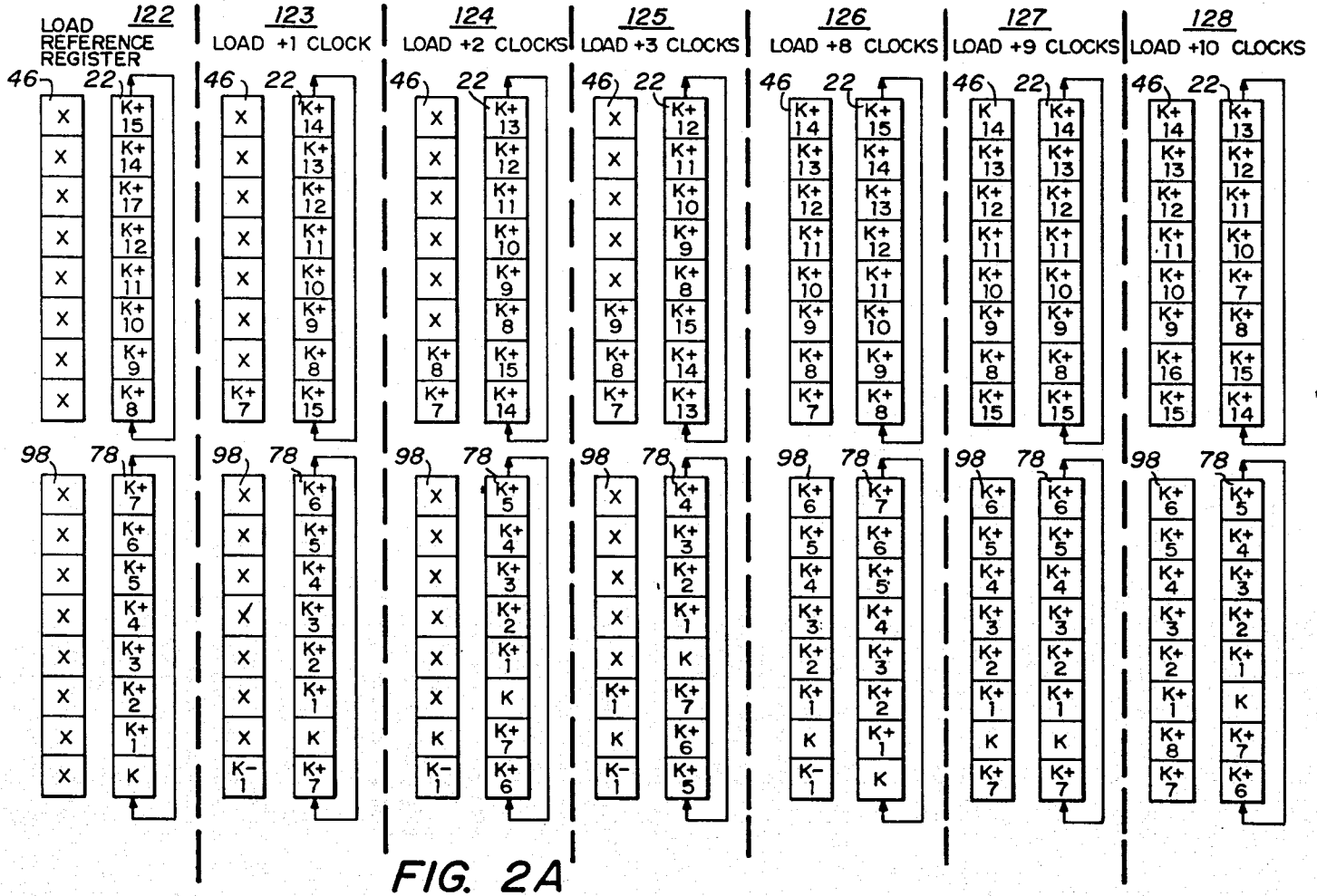
FIGS. 2A–2C are illustrations of analog sample st age and transfer together with the clocking of a ref ence code through a circulating register to provi alignment between the samples of the incoming sigr and the stored reference code.
Figure 2B:
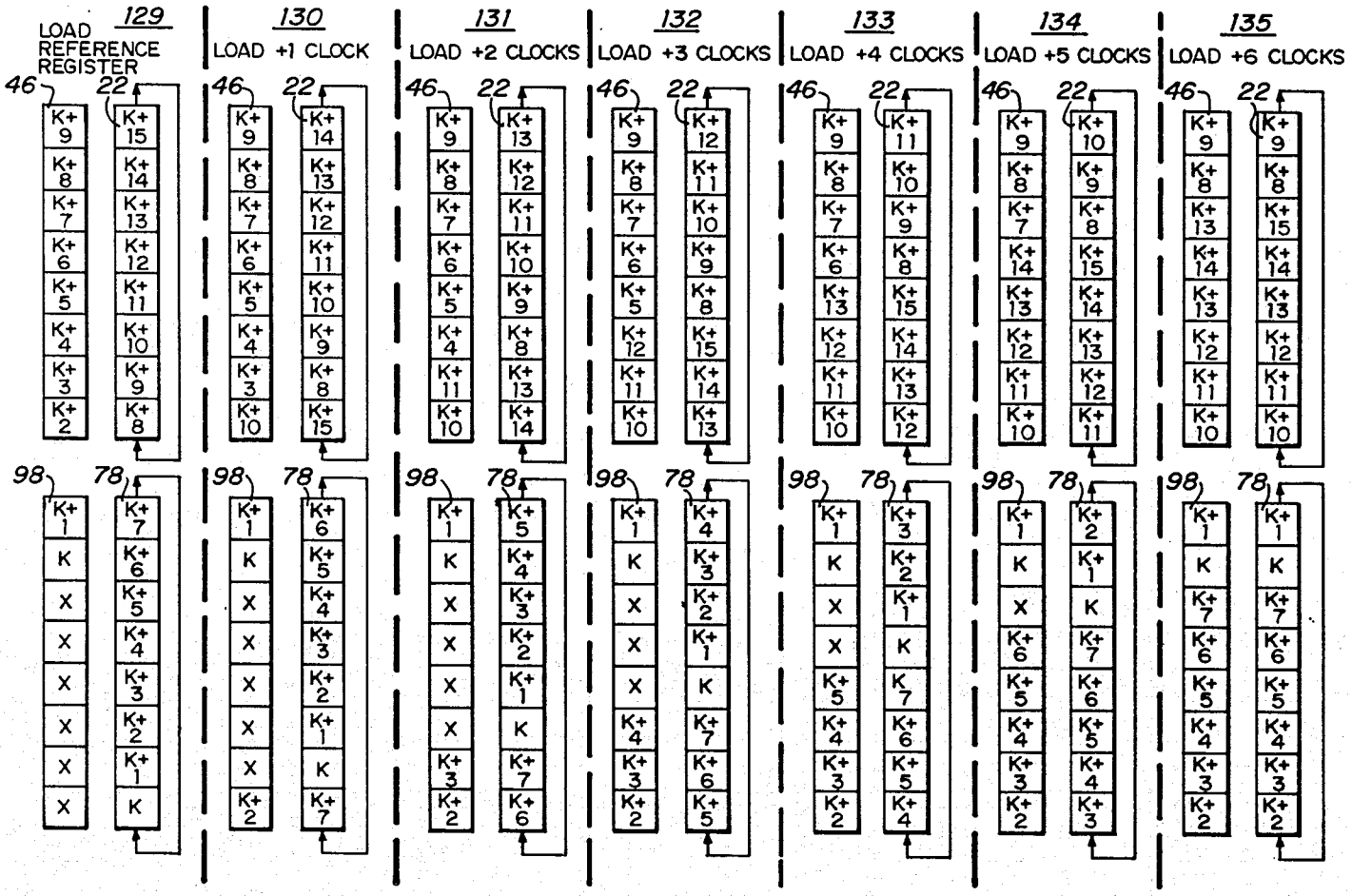
Figure 2C:
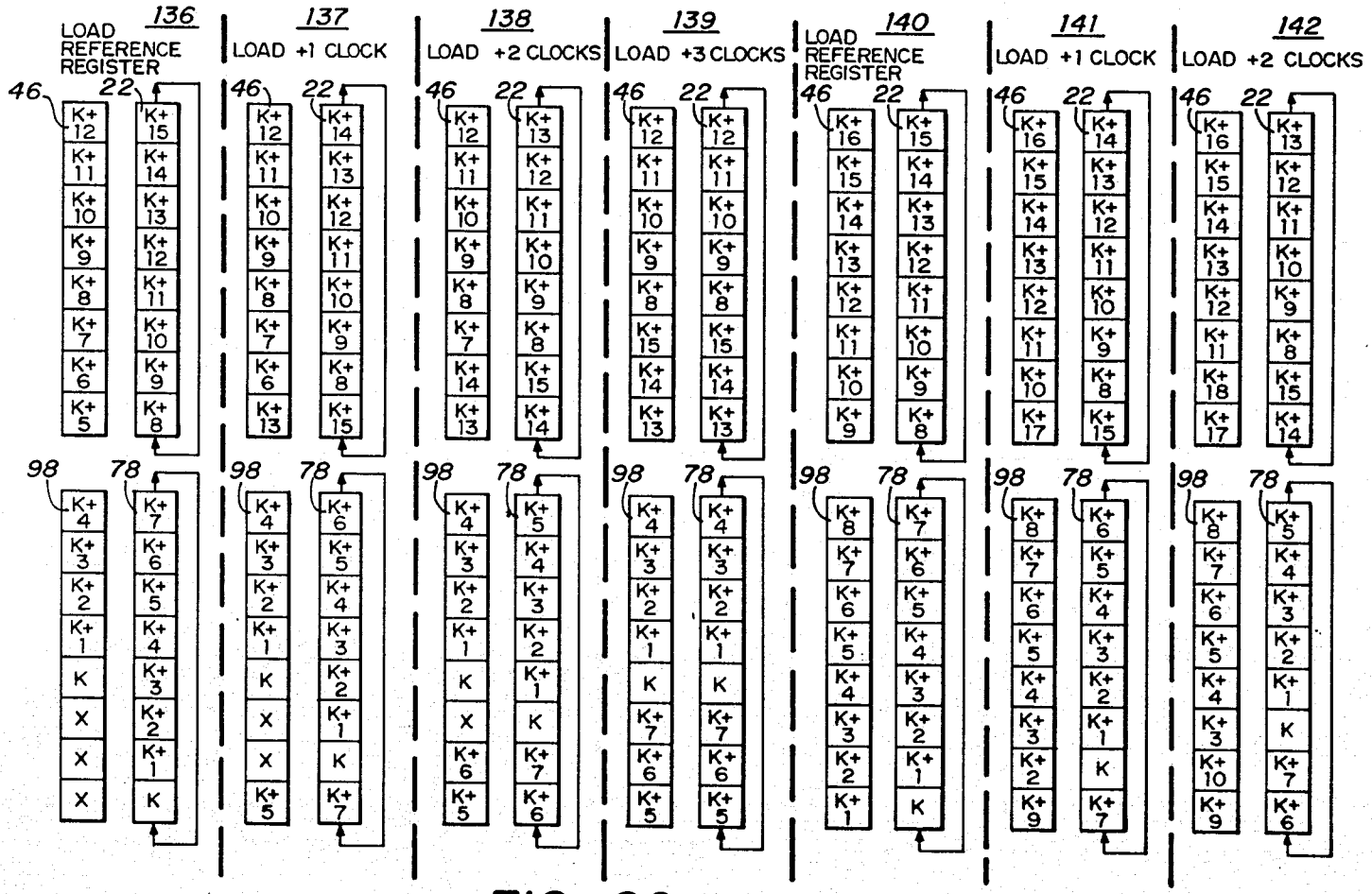

The flow of data through various registers of the transversal correlator 10 is shown in FIGS. 2A–2C. The sequential states of data are shown from left to right in FIG. 2A as data states 122, 123, 124, 125, 126, 127 and 128, in FIG. 2B as data states 129, 130, 131, 132, 133, 134 and 135 and in FIG. 2C as data states 136, 137, 138, 139, 140, 141 and 142. These data states are representative of a correlator having two 8-bit subsections. The analog data states are represented for sample and hold circuits 46 and 98 and the reference data states are shown for registers 22 and 78. For this example, it is assumed that the noted registers and circuits are eight bits long. States 122, 129, 136 and 140 represents the condition of circuit 10 at the time that the reference PN sequence is parallel shifted from the loading registers 16 and 70 into the circulating registers 22 and 78. The states of the PN code sequence for both the sample analog input signal and the stored PN sequence are given by the terms K, K+1, K+2, K+3 and so forth. The symbol X is used to represent a cell which was loaded before or at the time of the parallel transfer of a new PN sequence segment to the circulating registers 22 and 78. Note that the feedback line is shown for each of the circulating registers such that the state of the last cell is transferred in the next step to be the state of the first cell.

States 122–142 represent the data conditions in the registers during succeeding clock periods as indicated. Note that the samples of the input signal are stored statically in the cells of circuits 46 and 98. This is in contrast with the circulation of the PN sequence in registers 22 and 78. It can be seen that the reference PN sequence in registers 22 and 78 is swept past the statically stored analog samples of the input signal. By means of circuitry described below, there is produced a correlation pulse whenever the PN sequence in the circulating registers is aligned with the corresponding PN sequence in the analog storage cells. Further note that when the analog storage cells 46 and 98 are filled that each new analog sample is placed in a cell to replace the oldest stored analog sample.

Note that in states 127, 135 and 139 the PN sequence in the analog cells is aligned with the reference PN sequence in the circulating registers. At this point each of the correlator subsections 12 and 14 produces a correlation signal on the summation lines of circuits 36 and 88 which in turn causes the generation of a signal at the output of differential amplifiers 44 and 96 to produce an input pulse for detectors 60 and 110. The outputs of detectors 60 and 110 are summed by circuit 64 to produce a correlation output signal which comprises the fundamental output of the transversal correlator 10.

Note that correlation occurs for the full 8 analog samples in each case. The system timing is operated such that the lowest number analog sample is lower than the lowest number reference bit in the corresponding circulating register at the time of loading the circulating register.

Operation of the segmented, transversal correlator 10 is now described in reference to FIGS. 1 and 2. Before the correlation process can begin the reference PN code is loaded into registers 16, 70 and the similar registers in the remaining correlator subsections. A section of the PN sequence is then transferred through a parallel shift into the circulating registers 22 and 78. Thus, each circulating register receives a different section of the overall PN sequence code. However, the actual group of bit signals received may be duplicated between one correlator subsection and another.

The analog input signal is transmitted through line 50 to the correlator subsection 12 and from line 50 to a delay line 118 where the input signal is then supplied to line 102 of correlator subsection 14. The delayed analog input signal is then transmitted from line 102 into a second delay circuit 120 for transfer to the next succeeding correlator subsection for similar use. This continues until the analog input signal is supplied sequentially to each of the correlator subsections. A sufficient number of correlator subsections may be utilized such that more than one bit of the input signal can be sampled at a given time.

An address pulse is provided through line 54 and this address pulse is sequentially stepped through address registers 52 and 104. When the address pulse is in a given cell of register 52 it causes the corresponding sample and hold circuit of the sample and hold circuits 46 to be activated to sample the incoming analog signal on line 50. And, at the same time, the analog signal is stored in the delay circuit 118 for transfer to the correlator subsection 14. Only one address pulse is present in the register 52 at any one time and a new address pulse is supplied to the register 52 when the previous address pulse is propagated out of the register 52. From this procedure it can be seen that the newest analog sample replaces the oldest stored analog sample. The operation of address register 104 and sample and hold circuits 98 is the same as that described for circuits 52 and 46.

The data states in each of the cells of the circulating register 22 serve to operate switches within the weighting circuits 36 to selectively connect the lines 48 to one of the summation lines 40 and 42 depending on the corresponding digital bit (low or high) in register 22. This operation likewise occurs with circulating register 78 and weighting circuits 88.

The analog samples in the sample and hold circuits 46 are summed on the lines 40 and 42. The difference in the summation signals from these two lines is produced at the output of amplifier 44. As long as the reference PN sequence in register 28 is not aligned with the PN sequence of the input signal, as represented by the samples in the cells of circuit 46, the summation sums on lines 40 and 42 will be essentially random. Negative and positive analog samples will both be summed on each line. But, when the reference PN sequence in circulating register 22 aligns with the corresponding PN sequence for the analog samples in the cells of circuit 46, the summation signals on lines 40 and 42 will be of substantial amplitude with opposing polarity. The difference in the signals will produce a difference signal on line 59 which has an amplitude greater than that which occurs in the absence of alignment. The detector 60 will then produce an output signal which is provided to the summation circuit 64. A similar procedure occurs within correlator subsection 14 to produce an output signal on line 112 to summation circuit 64. The outputs from all of the correlator subsections are summed to produce the correlation output signal 66 for the transversal correlator 10. The resulting correlation signal can then be used to synchronize a correlation loop to decode the received signal.

The PN sequence to be decoded can be easily changed by loading a new PN sequence code into the loading registers 16, 70 and so forth. The new PN sequence code is then shifted by a parallel load into the corresponding circulating registers 22, 78 and so forth. Thus, the transversal correlator 10 can be rapidly loaded to recognize any desired PN sequence.

The various clock signals are controlled to operate at essentially the same rate as the PN sequence bits so that there is one sample stored for each bit. Double sampling can be achieved by using two correlators in parallel and multiplexing the signals. The clocks can optionally be operated at multiples of the PN sequence bit rate such that multiple samples are taken for each signal period of the received signal. In the latter case the PN reference code must be compensated accordingly to match the received PN sequence.

Figure 3:
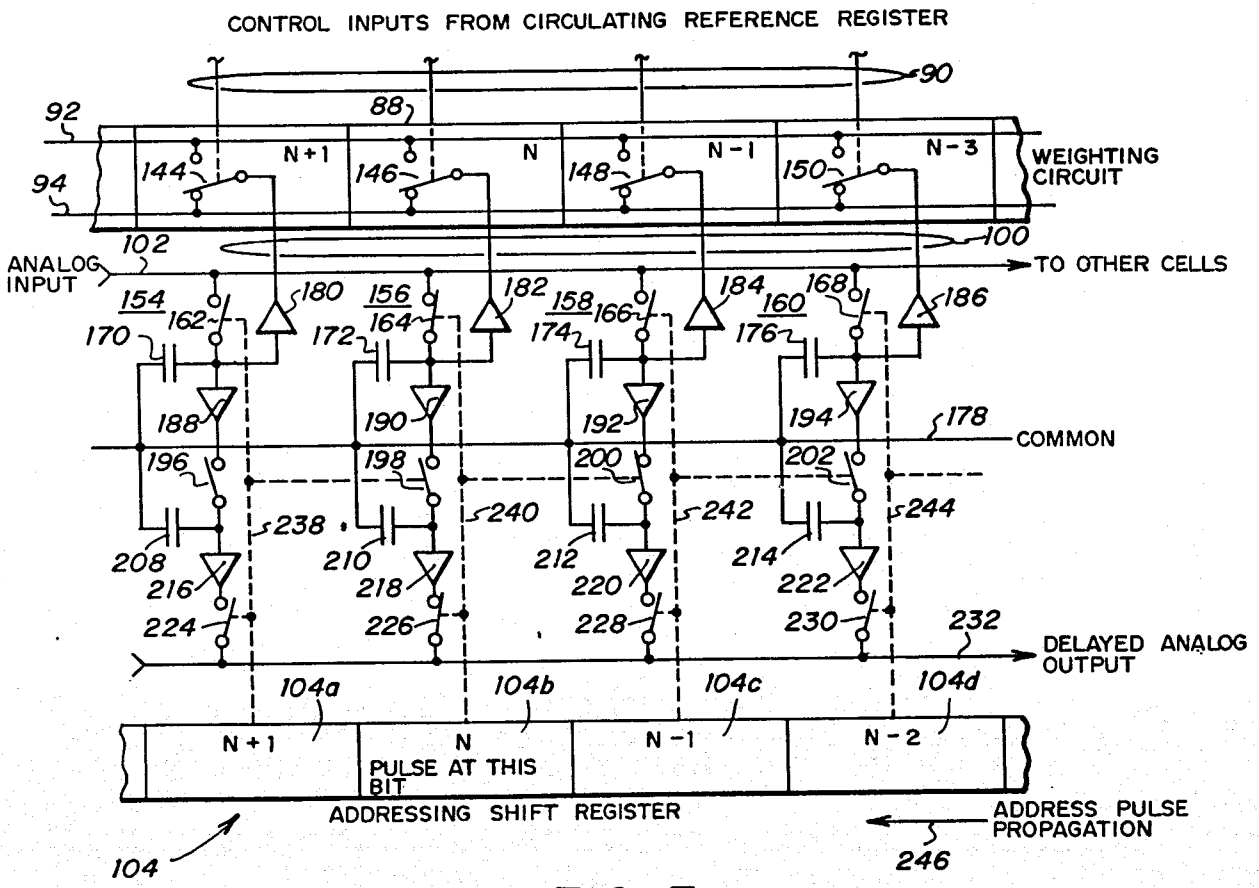
FIG. 3 is a schematic illustration of a circuit for pr viding sampling of the incoming signal together wi storage of the samples for a delay period.

Referring now to FIG. 3, there is shown a schematic illustration of circuitry which integrates the sample and hold circuits with the delay lines. The circuitry shown in FIG. 3 corresponds to the correlation subsection 14 shown in FIG. 1. The weighing circuit 88 is illustrated in greater detail. The lines 90 from circulating register 78 are connected to control the operation of switches 144, 146, 148 and 150. The analog samples are provided concurrently from circuits 98 through lines 100 to switches 144–150. The state of the signals on lines 90 controls the operation of the switches 144–150 to selectively connect the analog samples to either of the summation lines 92 and 94.

The address register 104 receives the address pulse which is indicated to be in the position N.

The circuit illustrated in FIG. 3 includes four sections 154, 156, 158 and 160 each of which comprises a sample and hold circuit integral with a delay circuit. The analog input signal is transmitted through lines 102 to switches 162, 164, 166 and 168 which are respectively in the circuit sections 154–160. When the switch for each circuit section is closed a storage capacitor is charged with the analog input signal to produce an analog sample. Capacitors 170, 172, 174 and 176 each have a first terminal connected respectively to the switches 162, 164, 166 and 168. The remaining terminal for each of these capacitors is connected to a common ground line 178.

The analog samples stored on capacitors 170, 172, 174 and 176 are transmitted through amplifiers 180, 182, 184 and 186 to the inputs of switches 144, 146, 148 and 150.

The analog samples on the storage capacitors 170, 172, 174 and 176 are also transmitted respectively through amplifiers 188, 190, 192 and 194 to switches 196, 198, 200 and 202.

Each of the circuit sections 154, 156, 158 and 160 includes respective second storage capacitors 208, 210, 212 and 214. Each of these second storage capacitors 208, 210, 212 and 214 are connected between the common ground line 178 and switches 196, 198, 200 and 202, respectively. The charge stored on capacitors 208, 210, 212 and 214 is transmitted respectively through amplifiers 216, 218, 220 and 222, respectively, to switches 224, 226, 228 and 230.

The switches 224, 226, 228 and 230 are each connected to a delayed analog output line 232.

Each of the cells of register 104 is connected to control the operation of three of the switches in circuit sections 154, 156, 158 and 160. Cell 104*a* of register 104 is connected through a control line 238 to control the states of switches 162, 198 and 224. Cell 104*b* is connected through a line 240 to control switches 164, 200 and 226. Cell 104*c* is connected through line 242 for controlling switches 166, 202 and 228. Cell 104*d* is connected through a line 244 for controlling switches 168 and 230 together with the switch in the next sequential circuit section (not shown) which corresponds to switch 196 in circuit section 154.

During operation of the circuit illustrated in FIG. 3, the address pulse N is propagated through register 104 in the direction indicated by arrow 246. For the illustrated embodiment the presence of an address pulse in a particular cell of register 104 causes the switches connected to that cell to be closed. Note that the address pulse is shown to be in cell 104*b* and that switches 164, 200 and 226 are closed. The remaining switches are open. Each cell of register 104 corresponds to one of the circuit sections 154, 156, 158 and 160. When the address pulse is present in a given cell, the two switches in the corresponding section are closed to connect that section to the analog input line 102 and the delayed analog output line 232. The center switch, which connects the charge storage capacitors, is open for the corresponding circuit section but is closed for the circuit section receiving the immediately preceding address pulse, such as shown for switch 200 within circuit section 158.

When the switch connected to the analog input line 102 is closed, the amplitude of the signal on the input line is sampled by the storage capacitor which is connected to the input line through a switch. As shown in FIG. 3, the switch 164 is closed to sample the signal on line 102 by charging capacitor 172. Note that as the address pulse propagates through address shift register 104, the corresponding circuit section will have the switch connected to the analog input line closed to charge the corresponding storage capacitor.

In the circuit section immediately preceding the circuit section corresponding to the position of the address pulse, the center switch, such as 200, is closed to route the analog sample on the first storage capacitor through an amplifier to the second storage capacitor within the circuit section. In FIG. 3, switch 200 is closed to charge capacitor 212 to the level of capacitor 174 thereby transferring the analog charge sample to capacitor 212. The analog sample stored on the delay storage capacitor 212 remains stored for one cycle of the address bit through register 104. When the address bit returns to the corresponding cell in the address register 104, the output switch, such as output switch 226, is closed to transfer the stored analog sample onto the delayed analog output line 232. This is illustrated by the closed switch 226 which connects capacitor 210 to line 232. The analog sample is stored for one time period corresponding to the time required for the address pulse to propagate through register 104. This is in turn dependent upon the rate of the clock signal provided to register 104.

As soon as the analog sample is taken from the input analog signal on line 102, it is provided through one of the amplifiers 180, 182, 184 and 186 such that it is applied to either of the summation lines 92 or 94. The selection of the summation line to which the analog sample is applied is determined by the state of the reference code bits on lines 90. The state of each of the lines 90 controls the position of the corresponding switches 144, 146, 148 and 150.

From the operation of the switches shown in FIG. 3, it can be seen that the analog input samples stored are the most recently collected samples and each new sample is stored in place of the oldest stored sample. Further, each sample is stored for one time period of the register 104 and then transmitted through an output line to the next succeeding correlator subsection.

Figure 4:
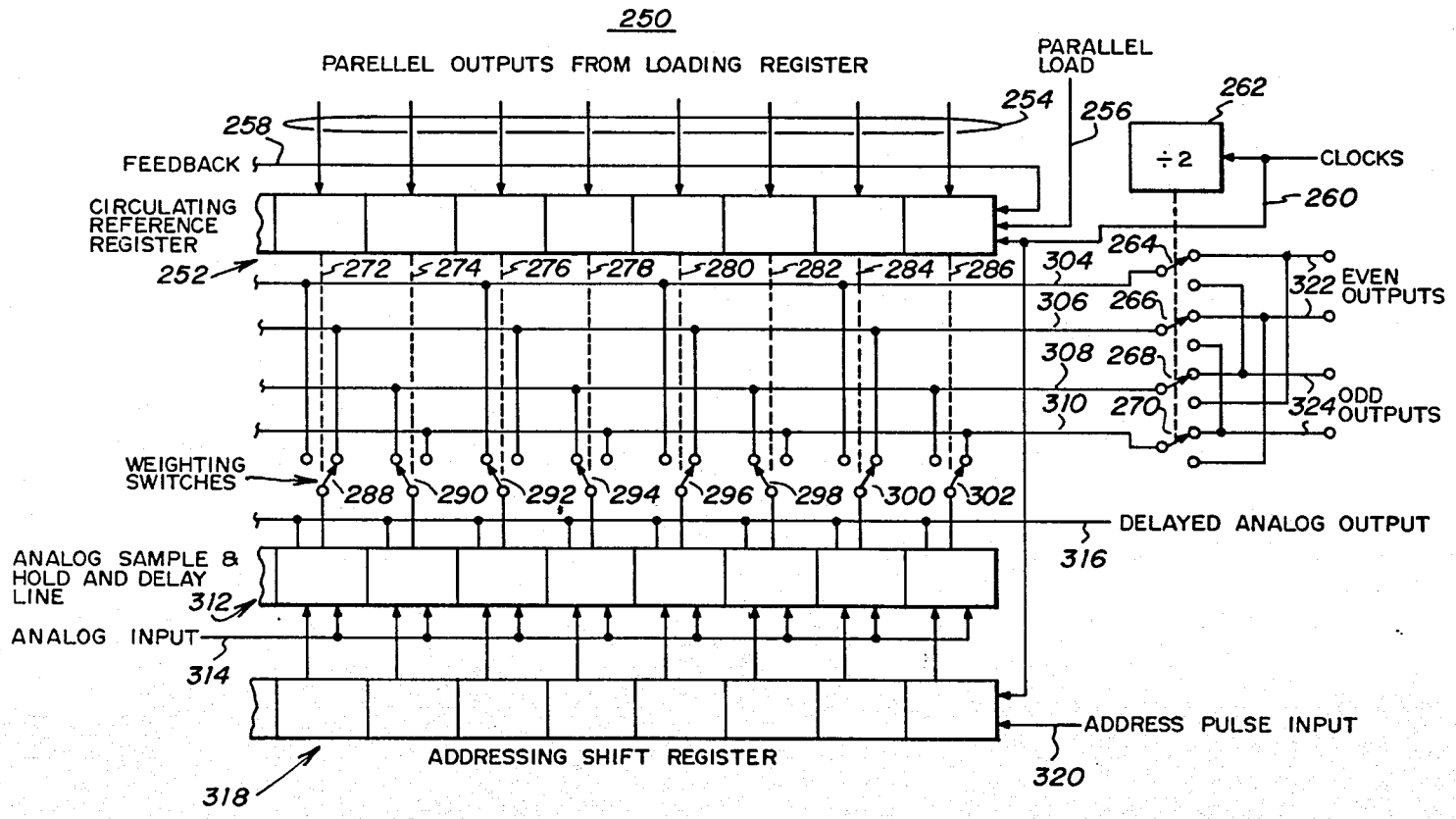
FIG. 4 is a schematic illustration of the process correlation wherein the reference signal code sele tively connects the analog signal samples to summati lines.

A further embodiment of a correlator subsection 250 in accordance with the present invention is illustrated in FIG. 4. A circulating reference register 252, such as described above, receives a parallel loaded input from a reference PN code loading register through lines 254. The parallel load command is supplied through a line 256. The last cell of register 252 is connected through a feedback line 258 to the first cell of register 252.

A clock signal is input through a line 260 into the register 252 for shifting the bit sequence stored therein. Line 260 is further connected to the input of a divide-by-two circuit 262, the output of which controls the operation of switches 264, 266, 268 and 270.

Each of the cells of register 252 is connected to a control line for operating a weighting switch. Control lines 272–286 are connected respectively to operate switches 288–302.

The correlator subsection 250 is provided with two sets of summation lines as opposed to the single pair of summation lines shown for the previous correlator subsections in FIGS. 1 and 3. Summation lines 304 and 306 are connected respectively to the poles of switches 264 and 266. Summation lines 308 and 310 are connected respectively to the poles of switches 268 and 270. Summation line 304 is connected to one of the two contacts of switches 288, 292, 296 and 300. Summation line 306 is connected to the other of the contacts of switches 288, 292, 296 and 300. Summation line 308 is connected to one of the two contacts of switches 290, 294, 298 and 302. The summation line 310 is connected to the other of the contacts of switches 290, 294, 298 and 302.

An analog sample and hold and delay line circuit 312 comprises a plurality of sections such as the sections 154–160 illustrated in FIG. 3. Each of the sections of circuit 312 is connected to receive the analog input signal on line 314 and produce a delayed analog sample output signal on a line 316.

An address shift register 318 receives an address pulse through a line 320 and the address pulse is shifted through the cells of register 318 by the clock signal received through line 260. The state of each of the cells in register 318 is transmitted to a corresponding section in circuit 312 for operation of the switches in the manner described above for the circuit in FIG. 3.

Operation of the correlator subsection 250 is now described in reference to FIG. 4. The reference PN bit sequence is transferred through a parallel load into the circulating register 252. The section of the PN bit sequence loaded into register 252 is circulated therein through the feedback loop 258 in response to the clock signal provided to the register. The correlator using the subsection 250 is designed uniquely to isolate odd and even reference PN bits. This is done by the use of the two pairs of summation lines together with the corresponding switches which are driven by the output of the divide-by-two circuit 262. The weighting function is carried out by the switches 288–302 in the same manner as described above wherein the state of a reference bit sets the connection of the corresponding weighting switch to connect the analog sample to one of the summation lines. In the correlator subsection 250, alternating ones of the circulating register cells of register 252 are connected to operate switches connected to the two different sets of summation lines. The divide-by-two circuit 262 alternately connects the summation lines 304 and 306 to the even output terminals 322 and to the odd output terminals 324. The output signal of circuit 262 also operates switches 268 and 270 to alternately connect summation lines 308 and 310 to the even output terminals 322 and the odd output terminals 324.

With the switches 264–270 operated in this manner the odd samples of the input analog signal will be correlated and provided to the odd output terminals 324. The even analog samples of the input signal will be correlated against the reference PN sequence and the resulting output signal transferred to the even output terminals 322. The outputs at terminals 322 and 324 are then transmitted to a differential amplifier in the manner shown for the summation lines in FIG. 1.

Figure 5:
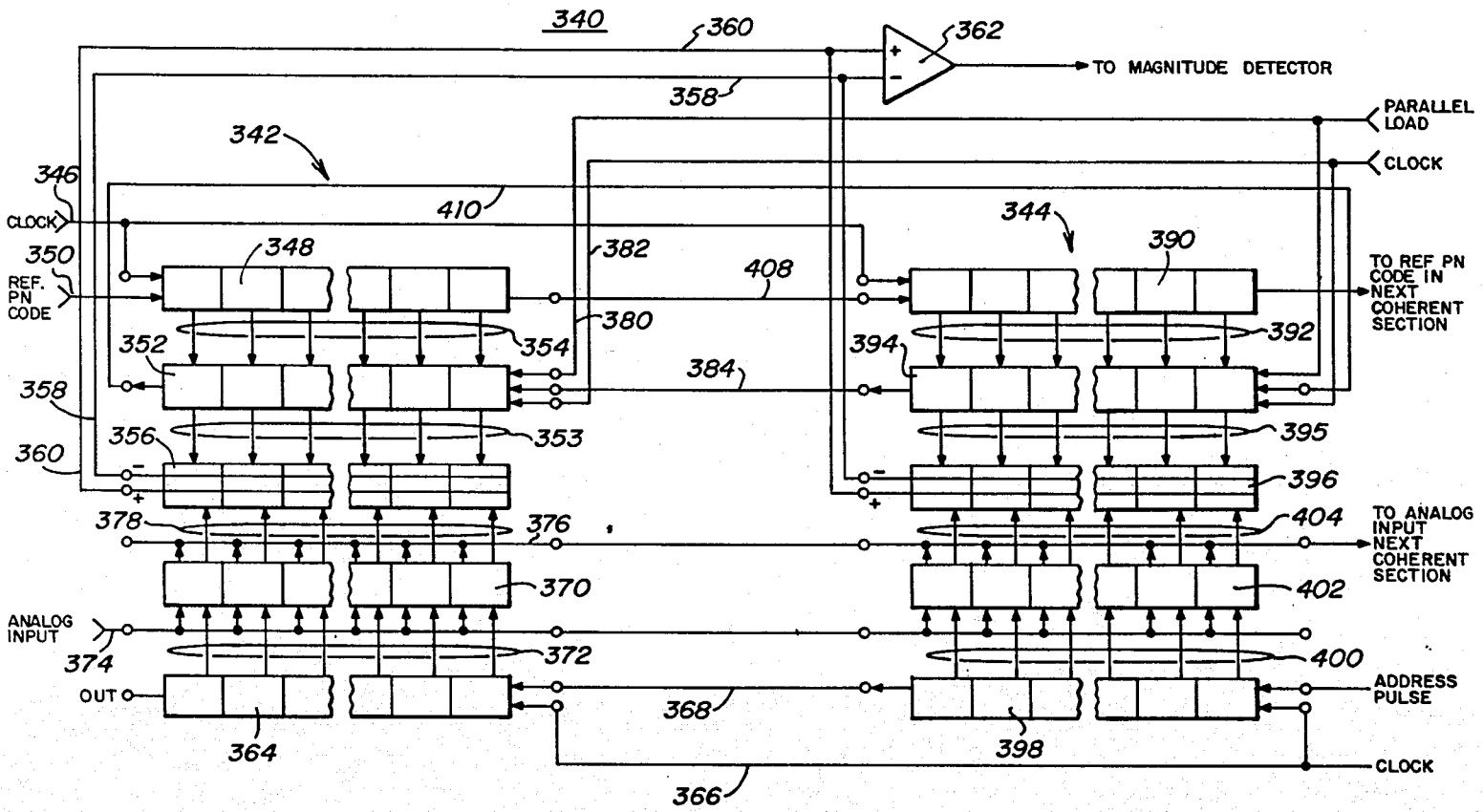
FIG. 5 is a schematic illustration of two correlat subsections which have been combined to form a corr lator coherent section.

A still further embodiment of the present invention is illustrated in a schematic diagram in FIG. 5. The circuit in FIG. 5 basically comprises two correlator subsections, as shown in FIGS. 1 and 3, which are connected together to serve as a coherent section for a correlator. The overall coherent section circuit is designed at a reference numeral 340. The coherent section includes two substantially identical circuits 342 and 344. A clock signal is then put on a line 346 to a PN code register 348 which receives a reference PN code on a line 350. Each of the cells of the register 348 is connected to a corresponding cell in a circulating register 352 through lines 354. The register 352 similarly has each cell thereof connected to a corresponding cell in a weighting circuit 356. The outputs from circuits 356 are transmitted on lines 358 and 360 to a differential amplifier 362.

An address shift register 364 receives a clock signal on a line 366 and an address pulse on a line 368. Each of the cells of register 364 is connected to a corresponding one of a group of sample and hold circuits 370 through lines 372.

The analog input signal as discussed above is input through a line 374 through each of the cells of the sample and hold circuits 370. The delayed analog input signal is transmitted through a line 376. The signal samples produced by the sample and hold circuits 370 are transmitted through lines 378 to each of the cells of the weighting circuit 356.

The circulating register 352 receives a parallel load command through a line 380, a clock signal through a line 382 and the sequential PN code through a line 384.

The second circuit section 344 of the coherent section 340 is essentially the same as section 342. Circuit 344 includes a PN register 390 connected through lines 392 to a circulating register 394. The circulating register has each cell thereof connected to a weighting circuit 396.

Circulating register 394 is connected to the weighting circuit 396 through lines 395.

An address register 398 is similarly connected to lines 366 and 368 and is connected through a group of lines 400 through a group of sample and hold circuits 402. Each of the cells of the sample and hold circuits 402 is connected to the analog input line 374. The delayed analog signal is transmitted from sample and hold circuits 402 to the delayed analog line 376. Each of the samples produced by circuit 402 is transmitted through one of the lines 404 to the respective cells of the weighting circuits 396. The two output lines from the weighting circuit 396 are connected to the lines 358 and 360 are input to the differential amplifier 362.

The PN register 348 is connected to serially transfer the PN code through a line 408 to the PN register 390.

The PN code is circulated through registers 394 and 352 and returned through a feedback path 410. Lines 380 and 382 are similarly connected to circulating register 394.

There are limits as to the number of correlation bits (analog sample and PN code bits) which can be included in a single correlator subsection, such as 12 shown in FIG. 1. One limiting factor is the size of the available integrated circuit chips. If the limiting factor is permitted only one half of a data bit to be correlated but it were desired to correlate a complete data bit, two correlators subsections can be combined together as shown in FIG. 5. Note that the PN code sequence utilized in the correlation scheme shown in FIG. 5 is double the length for each of the correlator subsections previously described. Also note that the address pulse is propagated serially through registers 398 and 364 to double the number of analog samples examined for each correlation cycle. Further note that there is no analog delay between the sample and hold circuits 370 and 402.

Although several embodiments of the invention have been illustrated in the accompanying drawings and described in the foregoing Detailed Description, it will be understood that the invention is not limited to the embodiments disclosed, but is capable of numerous rearrangements, modifications and substitutions without departing from the scope of the invention.

We claim:

1. Apparatus for correlating an input signal with a preselected bit sequence, comprising:

a plurality of correlation subsections each comprising:

means for sampling said input signal to produce a series of analog samples;

means for storing a preset number of said analog samples, each new sample replacing the oldest stored sample;

buffer register means for storing a section of said preselected bit sequence;

circulating register means parallel connected to said buffer register means for receiving said section of said bit sequence stored therein in response to a parallel load signal and sequentially circulating said bit sequence through the cells thereof;

means for correlating said bit sequence in said circulating register with said analog samples to produce a correlation signal when said bit sequence in said circulating register is aligned with a corresponding sequence of said analog samples in said means for storing;

delay means for serially transferring said input signal analog samples between each of said correlation subsections; and means for summing the correlation signals produced by each of said correlation subsections to generate a correlation output signal.

2. The apparatus recited in claim 1 wherein said buffer register means in each correlation subsection form a bit sequence register for storing the entire said bit sequence therein.

3. Apparatus as recited in claim 1 wherein said means for periodically sampling comprises:

a clocked register which receives a periodic sample signal at periods which are multiples of the period of the clock rate of said clocked register, said sample signal propagating through said clocked register, said clocked register having a plurality of cells therein, each said cell corresponding to a stage in said means for storing; and means for sampling said input signal after said sample signal transitions from one cell of said clocked register to another cell of said clocked register.

4. Apparatus as recited in claim 3 wherein said means for storing comprises a plurality of storage circuits each connected to receive said input signal and connected to a corresponding cell of said clocked register to receive a sample command signal.

5. Apparatus as recited in claim 1 wherein said circulating register means comprises a shift register connected to receive a clocking signal and having the last cell thereof connected to the first cell thereof.

6. Apparatus as recited in claim 1 wherein said means for correlating comprises:

a switch for each of said stored analog samples, each switch for connecting the corresponding analog sample to either one of two summation lines, said switches connected respectively to the cells of said circulating register means, said bit sequence in said circulating register means controlling the operation of said switches to connect said analog samples to said summation lines.

7. Apparatus as recited in claim 6 including a differential amplifier having inverting and noninverting inputs connected respectively to said summation lines.

8. Apparatus as recited in claim 1 including a magnitude detector coupled to receive said correlation signal to produce an output of one sense therefrom when said correlation signal has either a negative or positive sense.

9. A method for correlating an input signal with a predetermined bit sequence, comprising the steps of:

storing said predetermined bit sequence in a buffer register;

loading said bit sequence into a circulating register connected in parallel with the buffer register in response to a parallel load command;

sampling the input signal periodically to produce a series of analog samples;

storing a preset number of said analog samples in a corresponding set of storage circuits with each new sample replacing the oldest stored sample;

circulating said bit sequence through said circulating register; and correlating the bit sequence in said circulating register with said analog samples stored in said storage circuits to produce a correlation pulse when said bit sequence in said circulating register is aligned with a corresponding sequence of said analog samples in said storage circuits.

10. The method recited in claim 9 wherein the step of sampling the input signal is synchronized with the shifting of said bit sequence through said circulating register.

11. The method recited in claim 9 wherein the step of correlating comprises connecting each of said storage circuits to one of two summation lines through a selector switch which is controlled by the state of a corresponding bit in said circulating register.

12. A method for correlating an input signal with a predetermined bit sequence, comprising the steps of:

providing said input signal serially to each of a plurality of correlator subsections, said input signal delayed in propagation between each of said subsections;

sampling said input signal within each of said correlator subsections to produce a series of analog samples for each of said correlator subsections;

storing a predetermined number of said analog samples in storage circuits in each of said subsections;

circulating a different section of said bit sequence in a circulating register in each of said subsections;

correlating the section of the bit sequence circulating in each subsection with the corresponding analog samples stored in the storage circuits in the subsection to produce a correlation signal when the section of the bit sequence is aligned with the stored analog samples; and summing the correlation signals produced from each of said subsections to produce a correlation output signal.

13. The method recited in claim 12 wherein the time period of said propagation delay of said input signal between subsections is equal to the propagation time for the number of said samples stored in each of said subsections.

14. The method recited in claim 12 including the step of loading each of said circulating registers by parallel shifting said bit sequence from a reference register into each of said circulating registers.

15. The method recited in claim 12 including the step of magnitude detecting the correlation signal produced for each of said correlation subsections.

16. The method recited in claim 12 wherein the step of correlating for each subsection comprises connecting the analog samples in each of said storage circuits to one of two summation lines through a selector switch which is controlled by the state of a bit in a corresponding cell in the circulating register within the correlation subsystem.

17. Apparatus for correlating an input signal with a preselected bit sequence, comprising:

sampling means for periodically sampling said input signal to produce a series of analog samples, said sampling means including a clock register means which receives a periodic sample signal at periods which are multiples of the period of the clocked rate of said clock register, said clock register means having a plurality of cells therein;

storage means for storing a preset number of said analog samples, each new sample replacing the oldest stored sample, said storage means including a plurality of storage circuits each connected to receive said input signal and connected to a corresponding cell of said clock register means to receive a sample command signal;

buffer register means for storing said preselected bit sequence;

circulating register means parallel connected to said buffer register means for receiving said bit sequence from said buffer register means in response to a parallel load signal, said circulating register means including a shift register with the last cell thereof connected to the first cell thereof for sequentially circulating said bit sequence through the cells of the shift register; and correlation means for correlating said bit sequence and said circulating register means with said stored analog samples to produce a correlation signal when said bit sequence in said circulating register means is aligned with a corresponding sequence of said analog samples in said storage means.

18. Apparatus as recited in claim 17 wherein said correlation means includes odd and even summing buses, each summing bus including a pair of summation lines, said correlation means further including a weighting switch for each of the stored analog samples for connecting the corresponding analog sample to one of the two summation lines in either the odd or even summing bus, said bit sequence in said circulating register means controlling the operation of said weighting switches, said multiplexing means for alternatively connecting the odd summing bus and the even summing bus to an output terminal means.

19. Apparatus as recited in claim 1 wherein said means for storing and said delay means are integrated into a combined circuit, said combined circuit having plurality of sections corresponding to the number c cells in said circulating register means, each of sai sections including a sampling capacitor and a dela capacitor, and switch means controlled by said clocke register to control the operation of said combined ci cuit.

20. Apparatus as recited in claim 1 wherein said co relation means comprises:

a weighting switch for each of said stored analo samples, each weighting switch for connecting th corresponding analog sample to either one of tw summation lines, said switches connected respec tively to the cells of said circulating register mean said bit sequence in said circulating register mean controlling the operation of said switches to con nect said analog samples to said summation lines.

21. Apparatus as recited in claim 20 including a differ ential amplifier having inverting and noninverting in puts connected respectively to said summation lines.

22. Apparatus as recited in claim 1 including a magni tude detector coupled to receive said correlation signa to produce an output of one sense therefrom when sai correlation signal has either a negative or positive sense

* * * * *